US007182487B1

(12) United States Patent
Pickard et al.

(10) Patent No.: US 7,182,487 B1
(45) Date of Patent: Feb. 27, 2007

(54) HOUSINGS FOR INTERCHANGEABLE OPTICAL ASSEMBLIES

(75) Inventors: Paul Kenneth Pickard, Conyers, GA (US); James Michael Lay, Cumming, GA (US)

(73) Assignee: Acuity Brands, Inc., Atlanta, GA (US)

( * ) Notice: Subject to any disclaimer, the term of this patent is extended or adjusted under 35 U.S.C. 154(b) by 138 days.

(21) Appl. No.: 10/626,133

(22) Filed: Jul. 23, 2003

(51) Int. Cl.
*F21V 19/04* (2006.01)

(52) U.S. Cl. ..... 362/368; 362/372; 220/3.2; 174/535

(58) Field of Classification Search ..... 362/20, 362/183, 191, 646, 657, 368, 372; 206/418, 206/419; 220/3.92, 3.94; 174/54, 520
See application file for complete search history.

(56) References Cited

U.S. PATENT DOCUMENTS 2,273,167 A * 2/1942 Anderson ..... 362/410
2,863,038 A * 12/1958 Lombardo ..... 362/20
2,942,227 A * 6/1960 Hjelseth, Jr. ..... 439/351
3,302,918 A * 2/1967 Cohen ..... 362/404
3,739,226 A * 6/1973 Seiter et al. ..... 362/20
3,748,458 A * 7/1973 Morrison et al. ..... 362/267
3,772,527 A * 11/1973 Darling et al. ..... 362/396
4,218,725 A 8/1980 Heffner et al.
4,380,792 A * 4/1983 Terrell ..... 362/250
4,414,611 A * 11/1983 Seltzer et al. ..... 362/183
4,422,069 A 12/1983 Edstrom et al.
4,447,863 A * 5/1984 Fenne ..... 362/199
4,535,391 A * 8/1985 Hsiao ..... 362/183
4,661,892 A * 4/1987 Reed, Jr. ..... 362/657
4,778,966 A * 10/1988 Obata et al. ..... 200/314
5,339,234 A * 8/1994 Russello et al. ..... 362/419
5,599,089 A * 2/1997 Sheu et al. ..... 362/198
5,605,394 A * 2/1997 Chen ..... 362/197
5,727,865 A * 3/1998 Caldwell ..... 362/485
5,797,673 A * 8/1998 Logan et al. ..... 362/234
5,971,151 A * 10/1999 Tanaka ..... 206/419
6,019,477 A * 2/2000 Wegrzyn et al. ..... 362/20
6,045,242 A * 4/2000 Wegrzyn et al. ..... 362/375
6,129,440 A * 10/2000 Reynolds ..... 362/95
6,142,648 A 11/2000 Logan et al.
6,193,395 B1 * 2/2001 Logan ..... 362/285
6,398,394 B1 * 6/2002 Winnik ..... 362/183
D473,672 S 4/2003 Lay et al.
6,741,324 B1 * 5/2004 Kim, II ..... 362/249

* cited by examiner

*Primary Examiner*—Sandra O'Shea
*Assistant Examiner*—Ismael Negron
(74) *Attorney, Agent, or Firm*—Kilpatrick Stockton LLP

(57) ABSTRACT

Housings for emergency unit luminaires may be configured to receive both fixed and movable optical assemblies for mounting, allowing for the manufacture of a single housing for production of differing lighting products or lamp assemblies. Additionally, structural elements of a housing may support printed circuit boards, electronics, test devices, and the like, as well as permit electrical connections to be accomplished during assembly of front and back portions of the housing without the need for fasteners requiring tools.

17 Claims, 13 Drawing Sheets

Fig. 7A
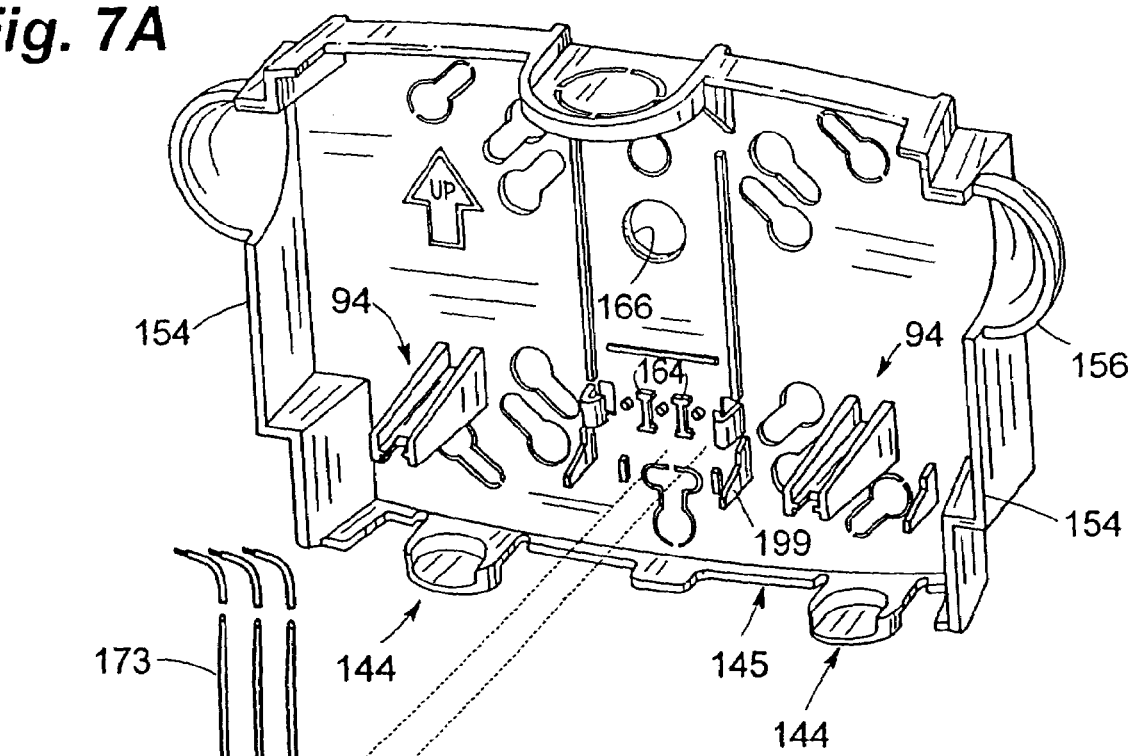
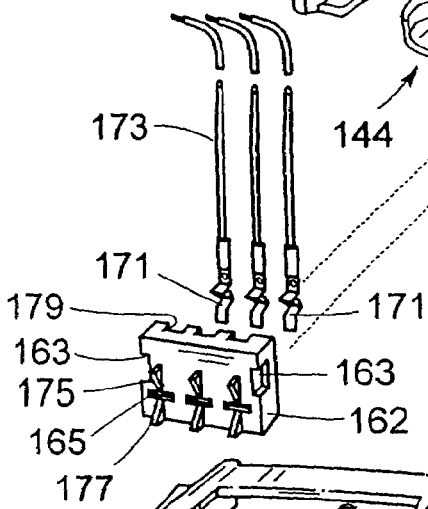
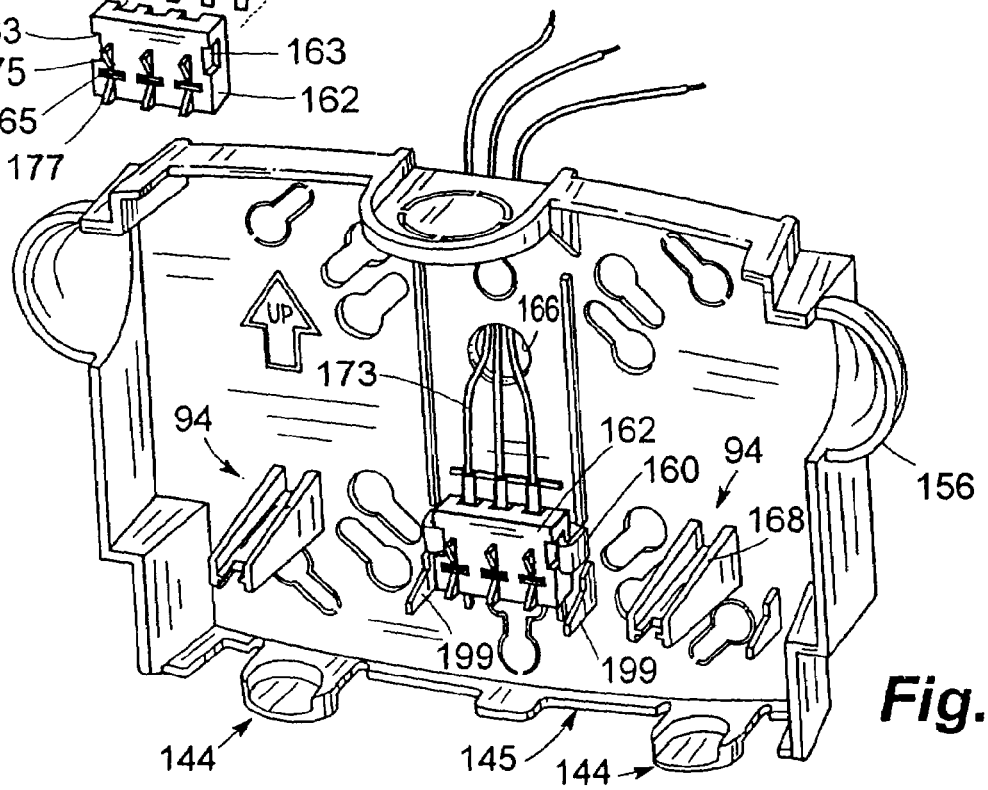
Fig. 7B

Fig. 10
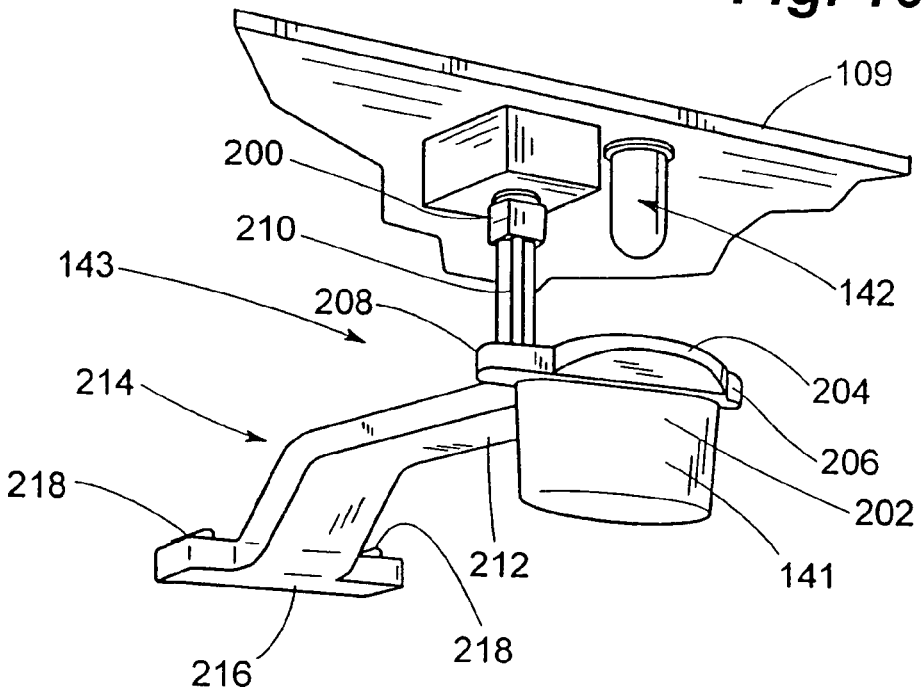
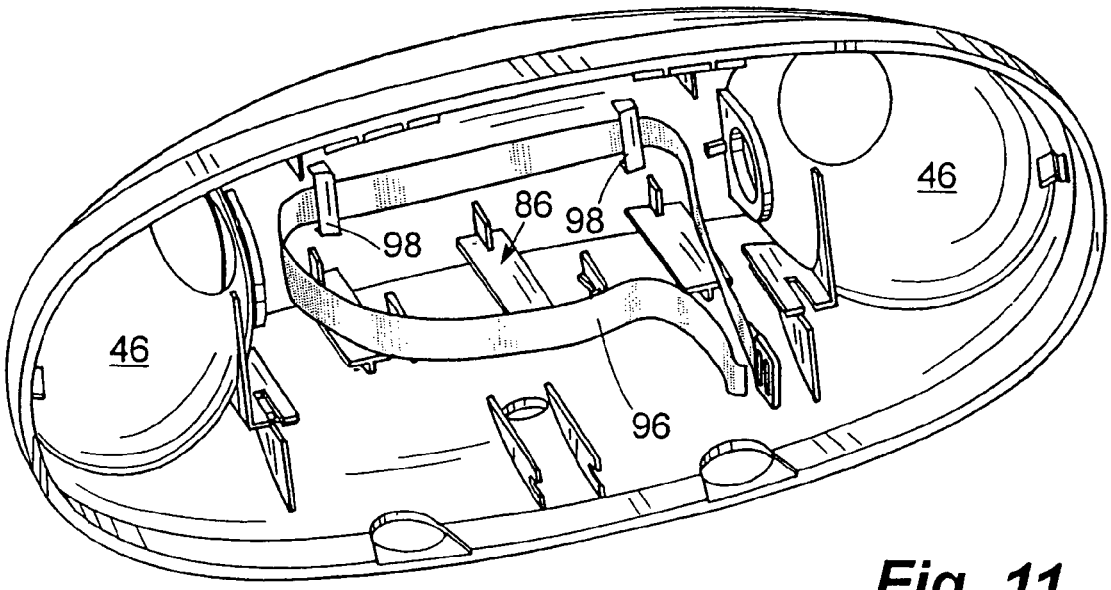
Fig. 11

HOUSINGS FOR INTERCHANGEABLE OPTICAL ASSEMBLIES

FIELD OF THE INVENTION

The invention relates generally to emergency lighting luminaires and particularly to housings for emergency unit luminaires.

BACKGROUND OF THE INVENTION

Building codes require emergency unit lighting fixtures for illumination of egress pathways, doorways, and the like to facilitate evacuation of a building during emergency conditions, such as when a main power supply to the building fails resulting in loss of usual illumination sources. Emergency unit fixtures provide a usable amount of light to enable evacuating persons to follow a preferred pathway out of the space being evacuated. Emergency unit fixtures or luminaires typically include a housing within which an emergency power supply, such as batteries, and circuitry are disposed for driving one or more lamps mounted to the exterior of the housing. In typical emergency unit luminaires, a pair of lamps are mounted to the top of the housing with each lamp being directed forward and to the side away from the housing. Such unit luminaires are often referred to as "frog eyes" and typically do not include a "legend" as exit signs do, thereby allowing use of emergency unit luminaires in locations inappropriate for exit signs.

Existing luminaires typically include either fixed optical assemblies or movable optical assemblies. Generally, a housing for mounting a fixed optical assembly has a different design and construction than a housing for mounting a movable optical assembly. In each type of emergency unit luminaire, the housing functions to mount optical assemblies, as well as to contain a source of emergency power supply along with necessary circuitry for operation and testing of the luminaire. Existing luminaire housings made of polymeric materials are often subject to material "creep" or sag due to the weight of a power supply, such as a battery, that is intended to be supported by the housing. Additionally, existing luminaires are time consuming to install and difficult to maintain because of fasteners that require tools for assembly and disassembly of the luminaire.

One existing unit luminaire includes external lamping mounted on a luminaire housing and aimed to direct light into a space in order to facilitate evacuation of the space when an emergency arises. Another existing emergency unit luminaire includes movable optical assemblies mounted to each end of the luminaire housing. Yet another existing device includes movable lighting assemblies operable within a combination emergency unit/exit sign. These existing movable optical assemblies are capable of swiveling or other motion, providing a single degree of freedom so that light from the optical assemblies may be directed toward desired locations.

Despite the existence of numerous commercially available emergency unit luminaires, there remain needs for a luminaire housing that is usable with both fixed and movable optical assemblies, configured to transfer at least the weight of a contained power source to a structure to which the housing is mounted, and easily installed without the use of tools and capable of ready disassembly for maintenance.

SUMMARY OF THE INVENTION

This invention provides housings for emergency unit luminaires. A housing may be configured to receive both fixed and movable optical assemblies for mounting, allowing for the manufacture of a single housing for production of differing lighting products or lamp assemblies. A housing may also include structure that transfers at least some of the load associated with a contained power supply and other operational components to a wall or similar structure onto which the luminaire is mounted. Additionally, structural elements of a housing may support printed circuit boards, electronics, test devices, and the like, as well as permit electrical connections to be accomplished during assembly of front and back portions of the housing without the need for fasteners requiring tools.

In one embodiment of this invention, a housing for an emergency unit luminaire includes at least one concavity within which a movable optical assembly and a fixed optical assembly may be interchangeably mounted. Each concavity may include a first opening that receives a portion of a movable optical assembly when a movable optical assembly is mounted in the concavity and a second opening that receives a portion of a fixed optical assembly when a fixed optical assembly is mounted in the concavity. The housing may also include a front portion and a back portion that may be releasably engaged, wherein the front portion and back portion, when engaged, define a chamber that contains operational components of the luminaire. The front and back portions may be unitary structures formed of a plastic material.

In certain embodiments of this invention, a front portion of a housing may include sloped projections extending from an interior surface that engage receiving projections extending from an interior surface of a back portion of the housing such that surfaces of the sloped projections bias against surfaces of the receiving projections upon engagement of the front portion and the back portion to transfer weight associated with the front portion and the operational components of the luminaire to a structure of a building to which the back portion is mounted.

In certain embodiments of this invention, a front portion of a housing receives a printed circuit board that includes projections carrying electrical contact pads. A back portion of the housing mounts electrical contacts that are connected to a source of power external of the housing, and, upon engagement of the front portion and the back portion, the back portion guides the projections of the printed circuit board into engagement with the electrical contacts to form at least a portion of an electrical circuit.

A housing may also include a test mechanism that tests the operational status of components of the luminaire according to certain embodiments of this invention. The test mechanism includes a light-transmissive push button extending through an opening in the housing, a light-transmissive base operable with the push button, wherein the base carries light from a light emitting diode on a printed circuit board inside the housing, and an element that engages a test switch on the printed circuit board upon depression of the push button to initiate a test sequence. The push button, base, and element may be integrally formed.

According to certain embodiments of the present invention, front and back portions of a housing may be formed of a polymeric material, and the operational components may include a battery and a printed circuit board. The printed circuit board may be positively latched within the front portion of the housing, which may also include guide plates in the front portion, back portion, or both that guide the printed circuit board into engagement with electrical contacts upon engagement of the front portion and back portion.

Additional features and embodiments of this invention are set forth in the detailed description below.

BRIEF DESCRIPTION OF THE DRAWINGS

FIG. 7A is an exploded perspective view of the back plate shown in FIGS. 5A and 5B and wiring components.

FIG. 7B is a perspective view of the back plate and wiring components shown in FIG. 7A, with the wiring components mounted to the back plate.

FIG. 10 is a perspective view of a light pipe and test element actuator mountable to an embodiment of a face portion of a housing according to this invention.

FIG. 11 is a perspective view of a battery strap received in an embodiment of a face portion of a housing according to this invention.

DETAILED DESCRIPTION OF THE INVENTION

This invention provides housings useful for emergency unit luminaires. In certain embodiments, a housing is configured to receive both fixed and movable optical assemblies for mounting, allowing for the manufacture of a single housing for production of differing lighting products or lamp assemblies. A housing may also include structure that transfers at least some of the load associated with a contained power supply and other operational components to a wall or similar structure onto which the luminaire is mounted. Additionally, structural elements of a housing may support printed circuit boards, electronics, test devices, and the like, as well as permit electrical connections to be accomplished during assembly of front and back portions of the housing without the need for fasteners requiring tools.

Figure 1:
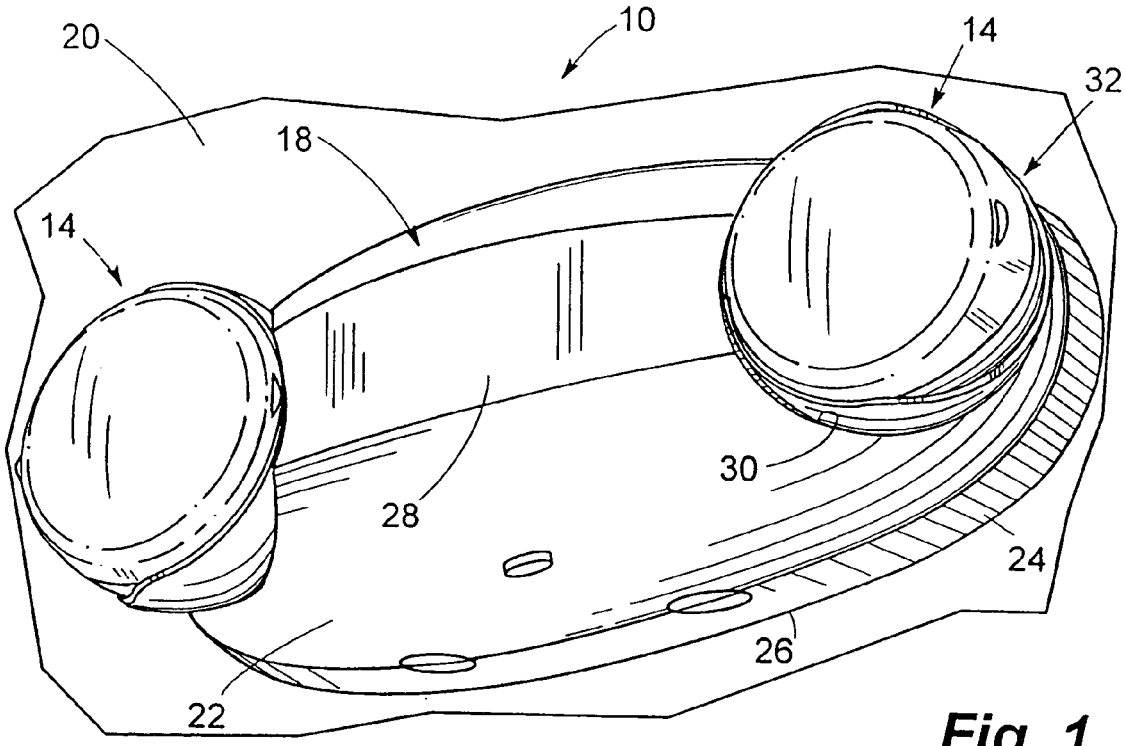
FIGS. 1 and 2 are perspective views of an embodiment of a housing for an emergency unit luminaire according to this invention, with movable optical assemblies and fixed optical assemblies, respectively, mounted thereto.
Figure 2:
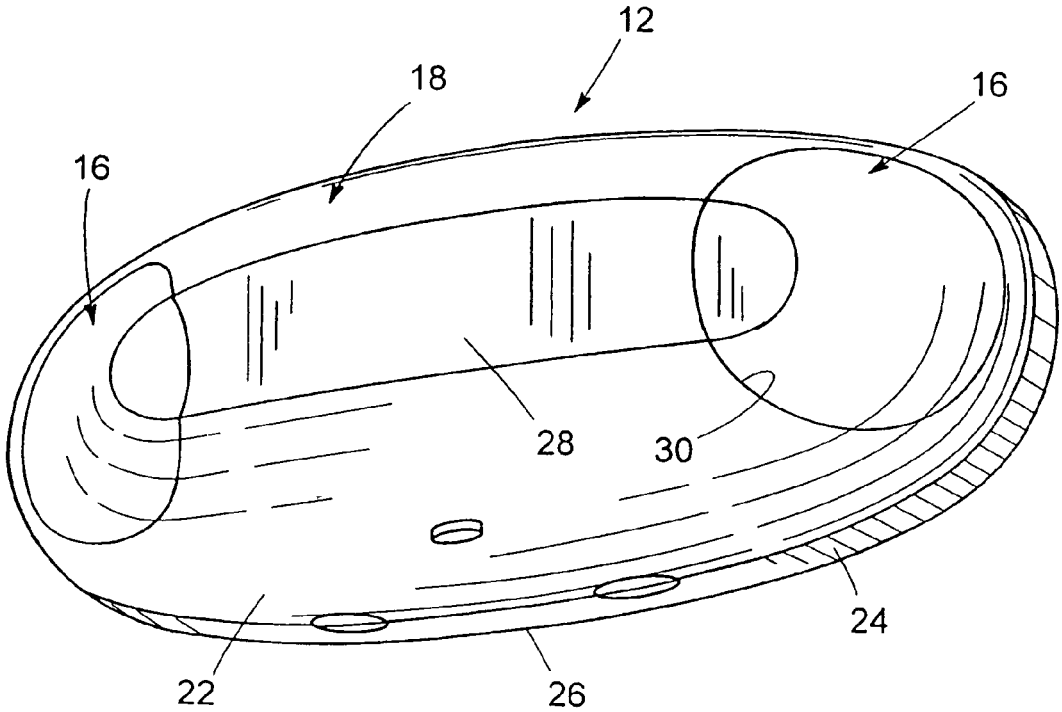

Referring now to the drawings, an emergency unit luminaire 10 includes two movable optical assemblies 14, as shown in FIG. 1. FIG. 2 shows an emergency unit luminaire 12 with two fixed optical assemblies 16. Optical assembly 14 may take the form of any embodiment of the lamp assemblies disclosed in commonly-assigned U.S. patent application Ser. No. 10/626,348, filed of even date, entitled "Lamp Assemblies for Emergency Lighting Fixtures," the entire contents of which are hereby incorporated by reference. Optical assembly 16, shown in more detail in FIG. 12 and described further below, includes a reflector 228, a lens 220, and a lamp 240 carried by an electrical socket 238.

A housing 18 includes a face portion 22 with two concavities 30 that each receive an optical assembly 16, as shown in FIG. 2. Concavities 30 may also receive optical assemblies 14, as shown in FIG. 1. Luminaires 10 and 12 of FIGS. 1 and 2, respectively, include the same housing 18 that is useable as a major component of each of the luminaires. As shown in FIG. 1, each optical assembly 14 includes a housing shell 32 that moves pivotably within concavity 30 such that optical assembly 14 may be manually manipulated to a position where light is directed toward a desired location. Similarly, each optical assembly 16 may be mounted within a concavity 30, as shown in FIG. 2. Each optical assembly 16 is mounted in a fixed position such that light is directed from assembly 16 to a predetermined location within an environmental space within which luminaire 12 is mounted. It should be understood that an emergency unit luminaire with housing 18 may include movable optical assemblies, fixed optical assemblies, or a combination of fixed and movable optical assemblies. A single optical assembly of either type may be mounted in each concavity 30. It should be further understood that certain embodiments of a housing according to this invention may include a single concavity 30 or three or more concavities 30, allowing for one or three or more optical assemblies, movable and/or fixed, to be mounted to housing 18.

As shown in FIGS. 1 and 2, housing 18 is generally elliptical in shape when viewed from a front perspective, but it should be understood that the shape, dimensions, and appearance of housing 18 may vary widely. Housing 18 is preferably made of a polymeric material, such as polycarbonate/ABS (acrylonitrile butadiene styrene). Using polymeric materials, housing 18 may be readily molded with integrally formed structural components described herein. Luminaires 10 and 12 are mountable to a wall, ceiling, or similar structure within an environmental space that is to be illuminated during emergency conditions. In FIG. 1, a portion of a wall 20 to which luminaire 10 is mounted is shown. Face portion 22 includes a peripheral apron 24 with a free edge 26 disposed adjacent to or in contact with wall 20 upon mounting either of luminaires 10 or 12 to wall 20. For decorative purposes, an elongated depression 28 may be formed centrally in face portion 22 and extend across face portion 22, as shown in FIGS. 1 and 2.

Figure 3:
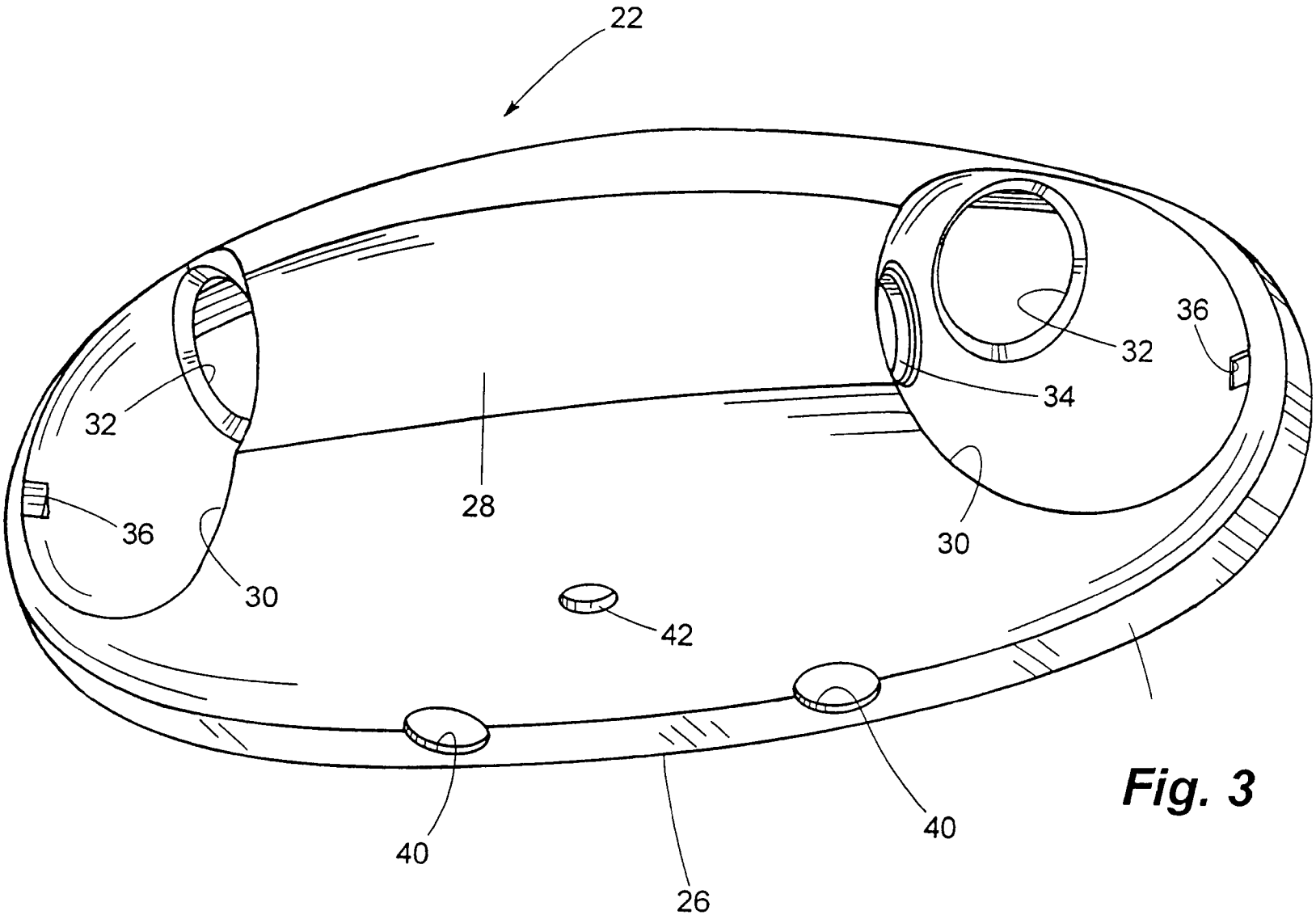
FIG. 3 is a front perspective view of a face portion of the housing shown in FIGS. 1 and 2.
Figure 4A:
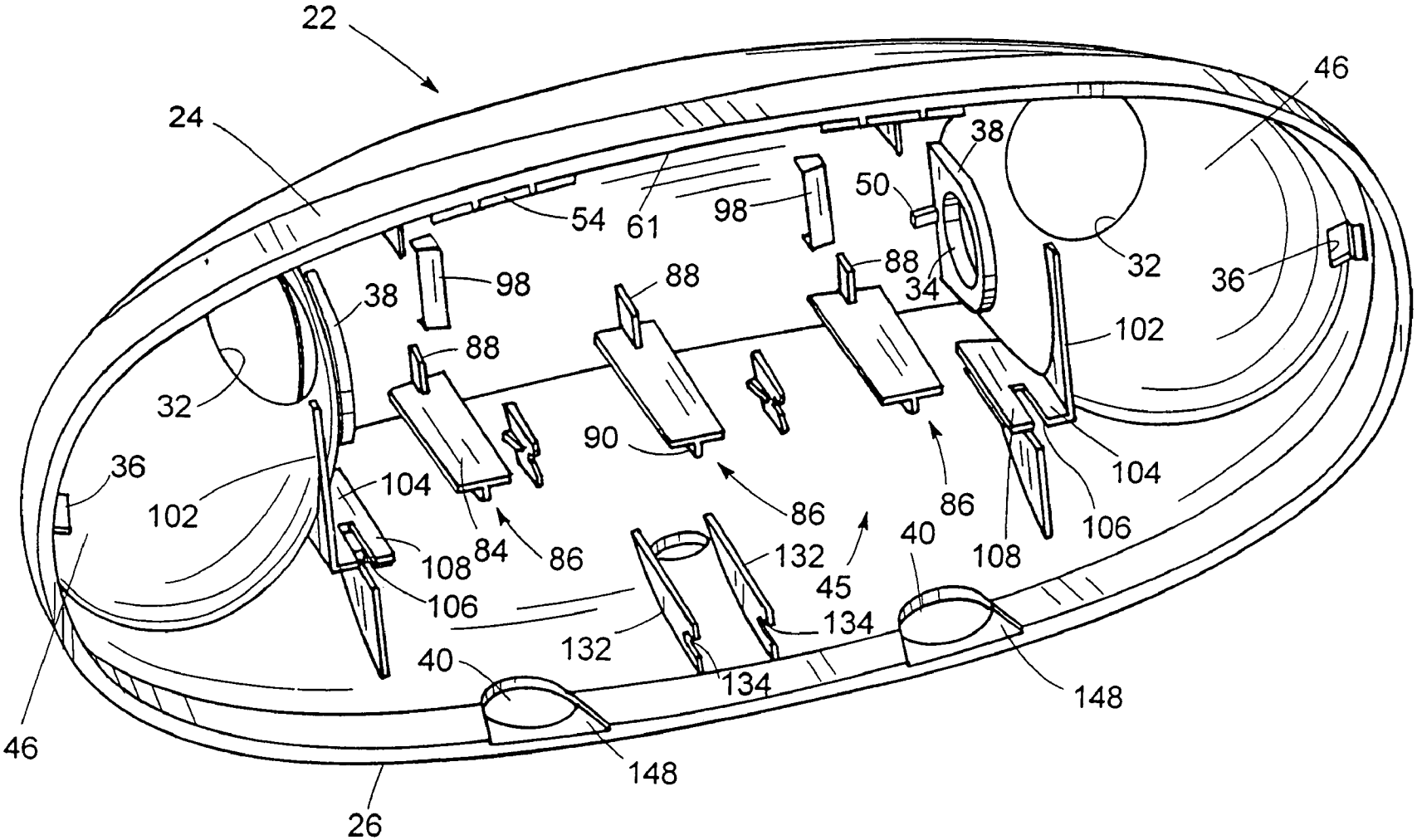
FIGS. 4A and 4B are rear perspective views of the face portion shown in FIG. 3.
Figure 4B:
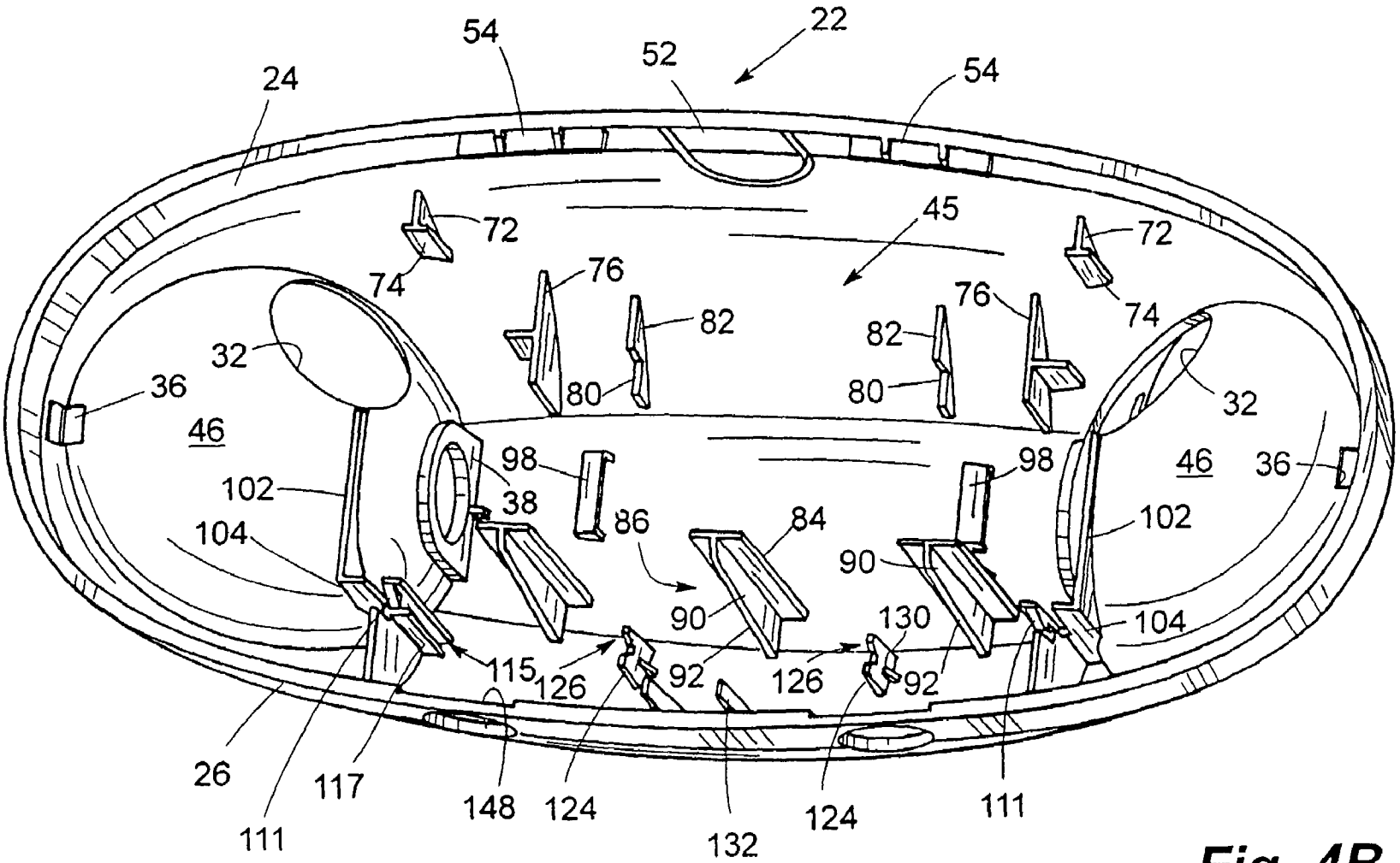

FIGS. 3, 4A, and 4B show face portion 22 of housing 18. Face portion 22 of housing 18 may be integrally formed, such as by molding of a polymeric material as described above. As shown in FIG. 3, each concavity 30 includes three openings, a central opening 32, an inner opening 34, and a rectangular opening 36. Central opening 32 is generally larger than openings 34 and 36. Rectangular opening 36 is formed at the outer periphery of concavity 30 and opposite inner opening 34. Openings 32 and 34 are preferably circular in shape. Opening 32 is used to mount fixed optical assembly 16, while opening 34 is used to mount movable optical assembly 14. Each opening 34 is formed in a planar flat 38 in concavity 30, as shown in FIG. 4A. Certain embodiments of particular structure for mounting movable optical assembly 14 in opening 34 are disclosed in U.S. patent application Ser. No. 10/626,348, which is incorporated herein by reference above.

Figure 6:
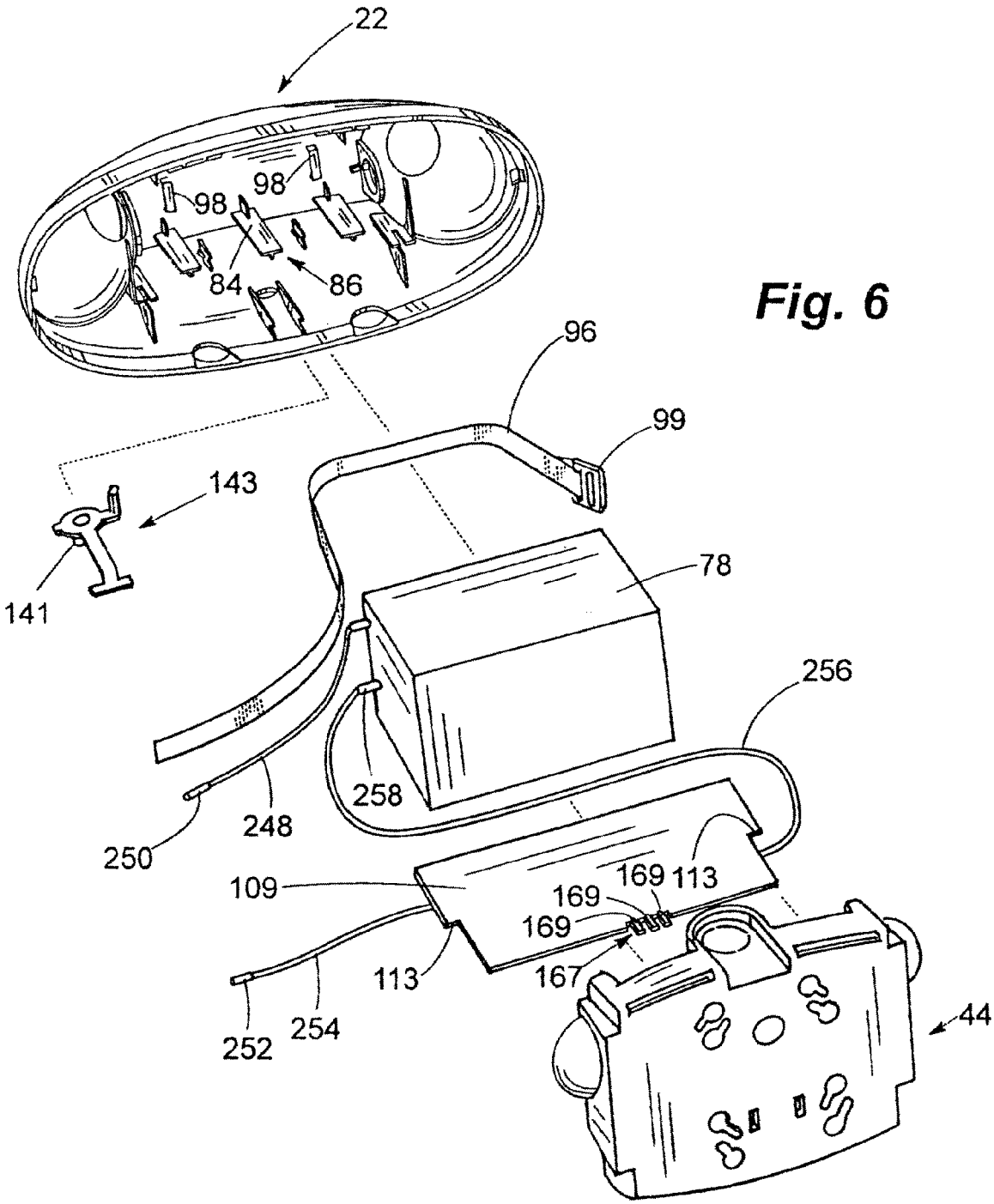
FIG. 6 is an exploded perspective view of the face portion shown in FIGS. 3, 4A, and 4B, operational components carried by the housing, and the back plate shown in FIGS. 5A and 5B.

Face portion 22 also includes apertures 40 that are partially formed in peripheral apron 24 and extend into portions of curved facing surfaces of face portion 22. As shown in FIGS. 3 and 4A, apertures 40 are generally circular. Aperture 42, which is generally elliptical, is disposed in face portion 22 and receives a lens 141 of a light pipe/actuator 143, which is shown in FIGS. 6 and 10. Light pipe/actuator 143 functions with a light-emitting diode 142 for testing purposes as further described below.

Figure 13:
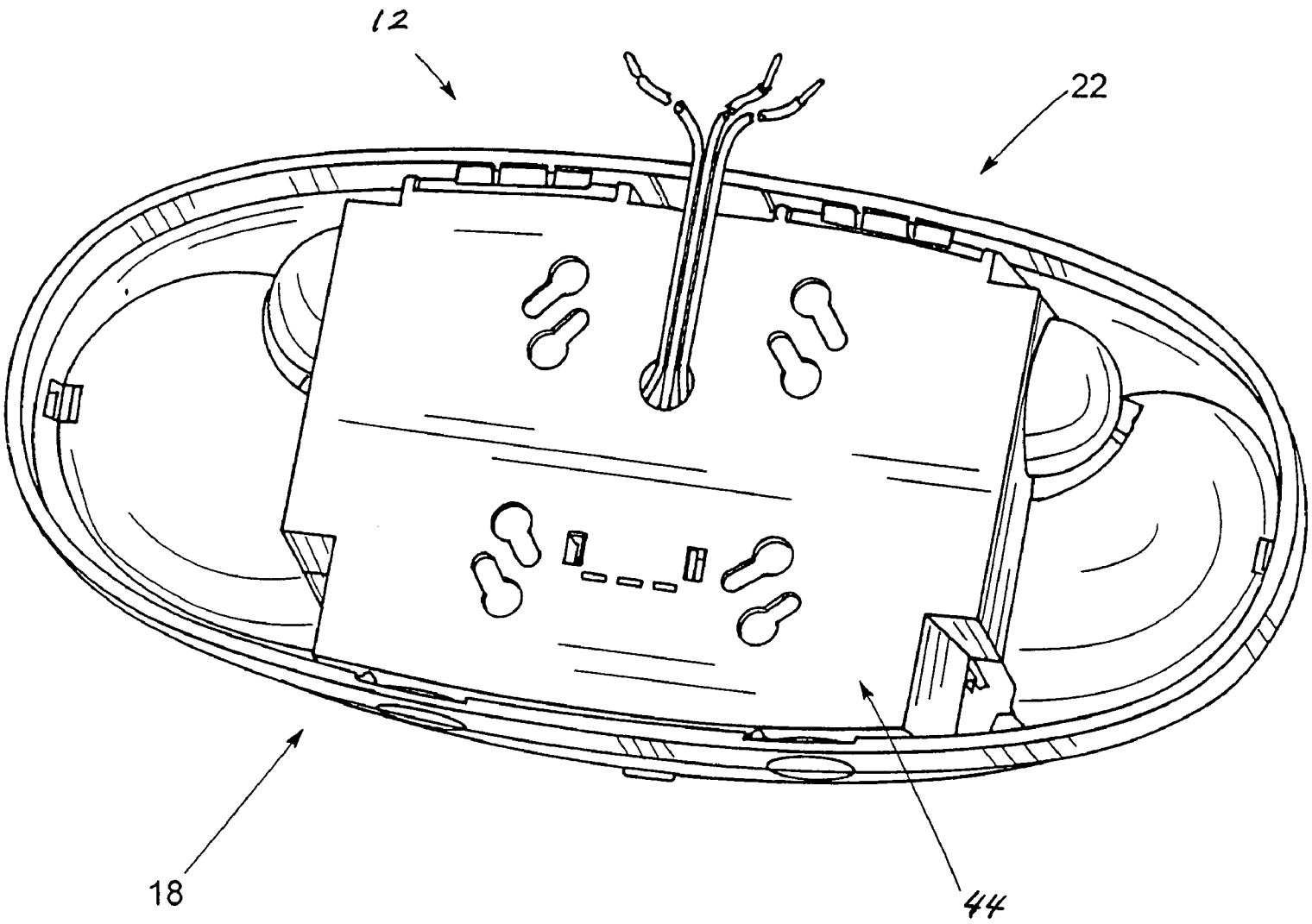
FIG. 13 is a rear perspective view of an embodiment of a housing according to this invention.

FIGS. 4A and 4B show face portion 22 in rear perspective views from locations above and below face portion 22, respectively. The side of face portion 22 shown in FIGS. 4A and 4B is the side facing toward the structure on which a luminaire including housing 18 is mounted. With a back plate 44 (see FIGS. 5A and 5B), the rear portions of face portion 22 define an interior chamber 45 that contains a power source, electronics, and other operational components typically employed in a unit luminaire. Back plate 44 may be molded as a unitary piece with structural components formed on back plate 44 to mate with certain structural components of face portion 22 and cooperable therewith to accomplish certain functions of housing 18 discussed herein. A rear view of housing 18 with face portion 22 and back plate 44 assembled is shown in FIG. 13.

Reference is now made to FIGS. 3 through 9B and 13 to provide a complete description of the interrelationship of the several structural components of face portion 22 and back plate 44. The views provided in FIGS. 3 through 9B and 13 particularly illustrate face portion 22 and back plate 44 and show each as molded component parts of a luminaire, such as luminaire 10 or 12 shown in FIGS. 1 and 2. FIG. 6 shows an exploded perspective view of various component parts of the luminaire that are mounted by face portion 22 such that they are within chamber 45 of housing 18 when back plate 44 is releasably connected to face portion 22. Other figures, for ease of illustration, show face portion 22 or back plate 44 without other components of the luminaire being shown.

Referring now to FIGS. 3 through 9B and 13, face portion 22 includes semispherical walls 46, as shown in FIGS. 4A and 4B, that define concavities 30, as shown in FIG. 3. Planar flats 38 are formed integrally with semispherical walls 46. A stop wall 50 is located at the juncture between each flat 38 and the inside surface of face portion 22. Stop walls 50 act with a corresponding portion of a mounted movable optical assembly 14 to prevent full 360° rotation of optical assembly 14 within concavity 30, which is necessary so that wiring from movable optical assembly 14 will not twist too much and become damaged.

Face portion 22 includes a knock out 52, shown in FIG. 4B, that permits a conduit (not shown) to extend into interior of housing 18 upon removal of knock out 52. The conduit contains wiring that is connectable in a conventional manner to electronics contained within housing 18. Snap plates 54 are located on each side of knock out 52 along peripheral edges of apron 24. Snap plates 54 are deformable to snap over edges 56 and 58 of back plate 44, shown in FIGS. 5A and 5B. A U-shaped stem wall 60 is disposed between edges 56 and 58 of back plate 44. Stem wall 60 defines contours of a plate 62 in which a knock out 64 is provided. Stem wall 60 and plate 62 fit beneath an upper peripheral edge 61 of face portion 22 and generally extend into the interior of housing 18. Removal of knock out 64 permits alignment with knockout 52 such that a conduit can extend into housing 18 as described above.

Plate 62 is supported at least in part by supports 66 that are preferably integrally formed with plate 62 and an interior back wall 68 of back plate 44. Key-shaped knock outs 70 are in various locations on back wall 68. One or more of knock outs 70 are removable in order to facilitate a desired mounting to a junction box using conventional fasteners, such as a junction box mounted to or flushly in the wall of a building, as well understood by those skilled in the art.

Face portion 22 includes protrusions 72 having flat-bottomed plates 74. Edges of protrusions 72 and plates 74 contact opposing portions of back plate 44 upon assembly of back plate 44 to face portion 22 to partially define and enclose chamber 45, which is described in further detail below. The contact between protrusions 72 and plates 74 with opposing portions of back plate 44 stabilizes, at least partially, assembly of the component parts of housing 18. Opposing interior plates 76, shown in FIG. 4B, act to assist in locating and holding in place a battery 78, shown in FIG. 6. Top edge portions of battery 78 fit within notches 80 in guide plates 82. Guide plates 82 facilitate locating and maintaining battery 78 in the desired location within housing 18.

As may be appreciated by reference to FIG. 6, battery 78 sits on upper surface plates 84 of three T-ribs 86. Spacer plates 88, shown in FIG. 4A, are located at surface plates 84 to maintain battery 78 at the appropriate location on surface plates 84. T-ribs 86 extend from an interior surface of face portion 22 in aligned and spaced relation to each other and also in spaced relation to and below protrusions 72 and guide plates 82. Leg portions 90 strengthen T-ribs 86 and have lower edges 92 that slope downwardly to junctures with the interior surface of face portion 22. The two outside T-ribs 86 cooperate with two H-ribs 94 formed on back plate 44, as further described below. Battery 78 is further maintained in place by means of a strap 96, shown in FIGS. 6 and 11. Strap 96 includes conventional cooperating fastening elements, such as hook and loop fastening elements or the like, so that strap 96 can quickly be fed through a pair of loops 98 formed on the interior surface of face portion 22, as shown in FIGS. 4A, 4B, 6, and 11. Strap 96 is wrapped about battery 78 and ends of strap 96 are connected together along with, optionally, a buckle 99 for additional security to maintain battery 78 in the desired location within housing 18.

Figure 8A:
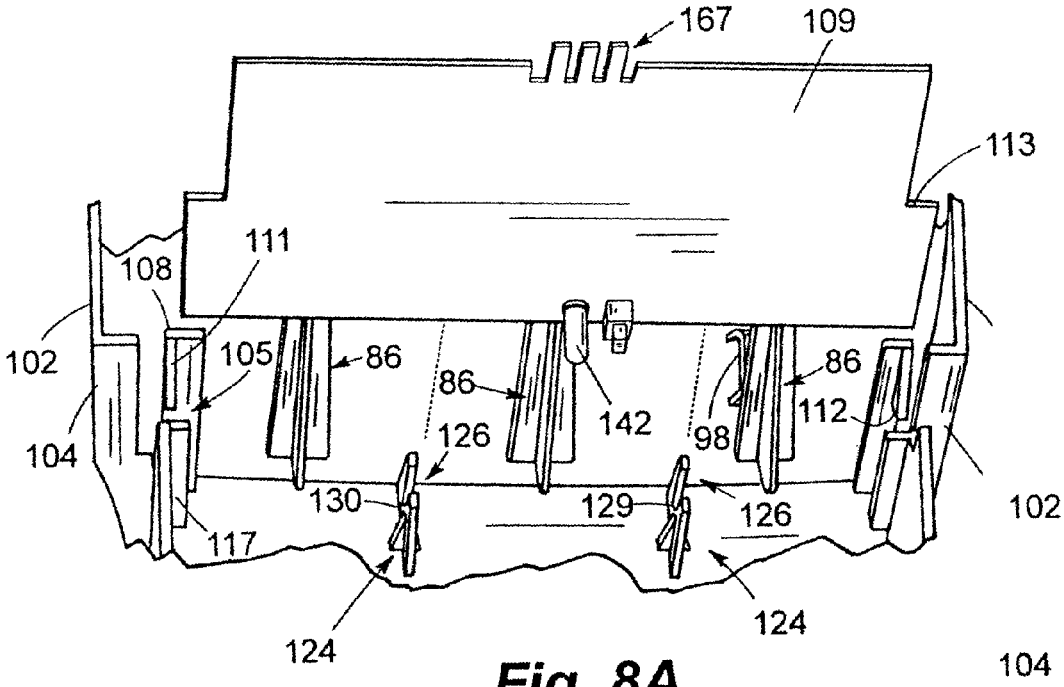
FIG. 8A is an exploded perspective view of a portion of the face portion shown in FIGS. 4A and 4B and a printed circuit board mounted in the face portion.
Figure 8B:
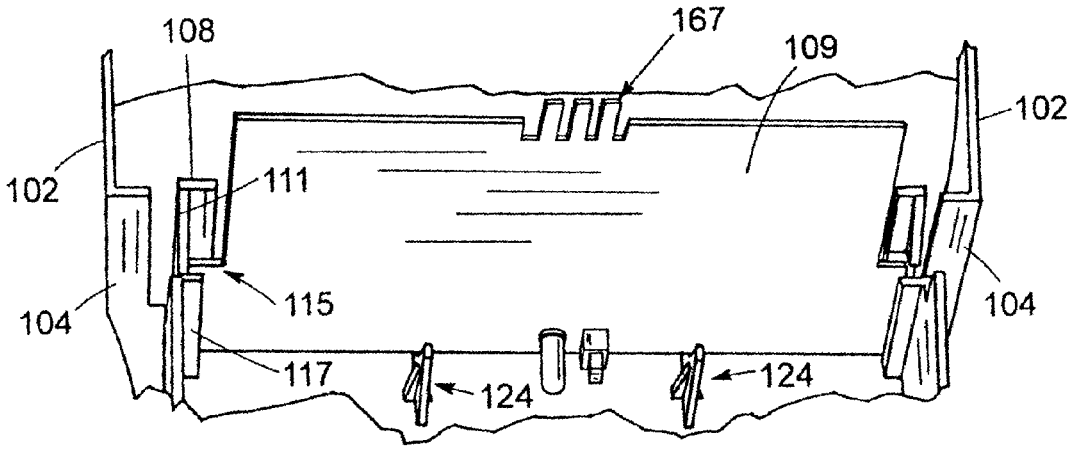
FIG. 8B is a perspective view of the printed circuit board shown in FIG. 8A mounted in the face portion.
Figure 9A:
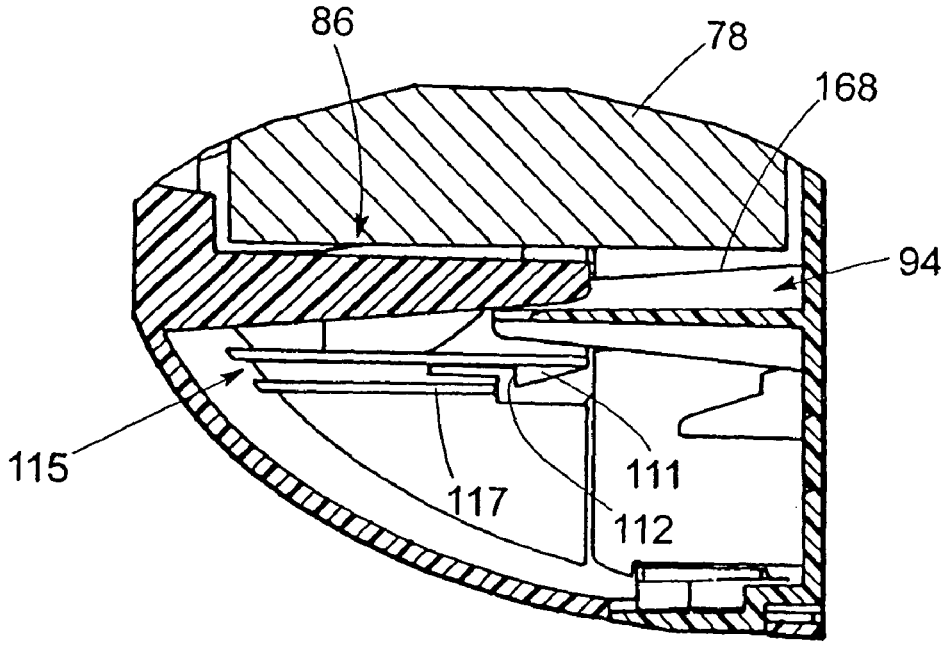
FIG. 9A is a detailed, cross-sectional elevation view of structure on the face portion and back plate of the housing shown in FIGS. 1 and 2 assembled and cooperating to mount a battery.
Figure 9B:
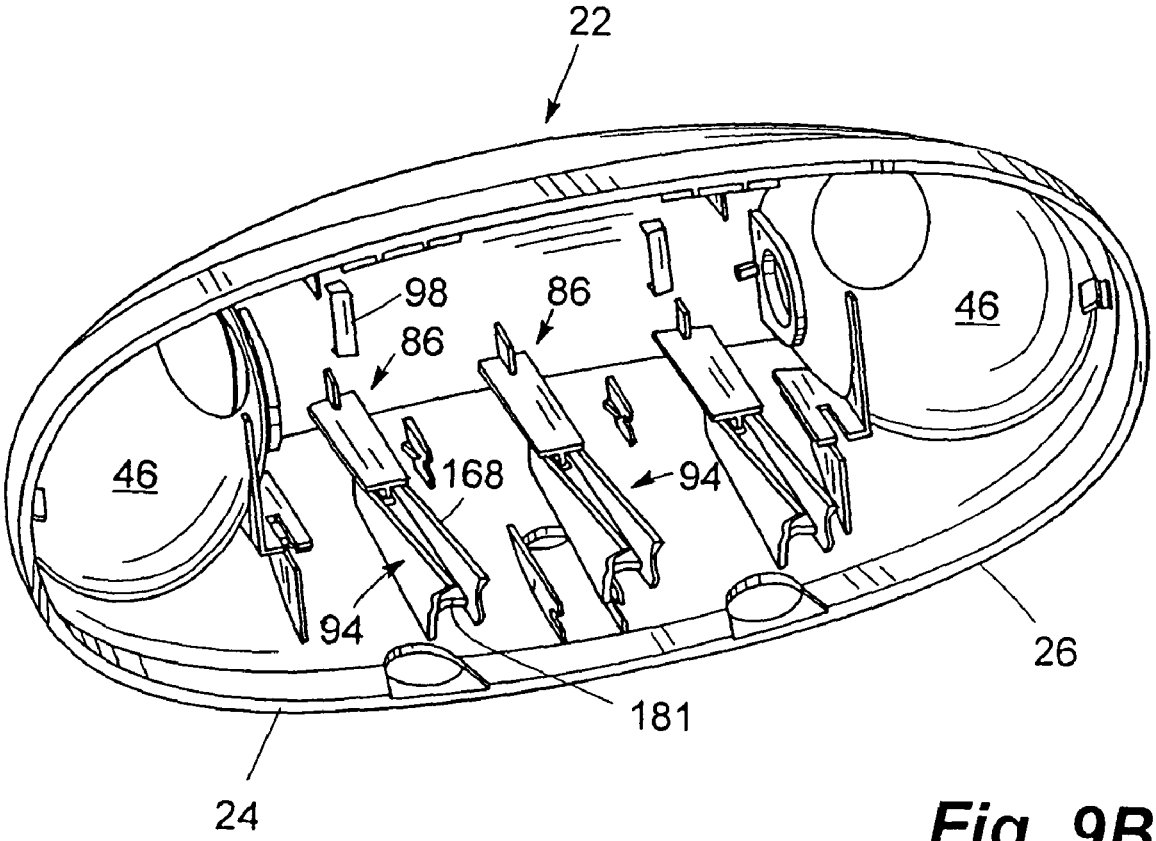
FIG. 9B is a perspective view of the face portion and portions of the back plate shown in FIG. 9A.

Referring to FIGS. 4A, 4B, 8A, and 8B as well as FIGS. 9A and 9B, walls 102 partially define chamber 45 and are formed on semispherical walls 46. Each wall 102 is generally L-shaped in combination with a plate 104 extending inwardly toward the center of the interior of housing 18. A notch 106 is formed in each plate 104 to allow respective tongues 108 to flex when biased inwardly upon contact between edges of a printed circuit board 109 and a ramp 111 formed on each of tongues 108. Ramps 111 each have a detent edge 112 formed as shown in FIG. 8A. Printed circuit board 109 includes a notch 113 cut away from each lateral edge so that rear edges of each of ramps 111 snap into notches 113 upon sufficient insertion of printed circuit board 109 past ramps 111. Detent edges 112 of ramps 111 engage notches 113 of printed circuit board 109 to hold printed circuit board 109 within tracks 115 that are defined by outer edge portions of plates 104 and opposing spaced plates 117 formed one each on inside surfaces of walls 102. Printed circuit board 109 is thereby positively mounted in an appropriate location within housing 18.

Printed circuit board 109 is further mounted along a front edge using guide plates 124 formed on the inside surface of face portion 22 below T-ribs 86, as shown in FIGS. 4B, 8A, and 8B. Guide plates 124 each include a shaped notch 126. Front edges 129 of each notch 126 angle downwardly and upwardly respectively such that front edges of printed circuit board 109 contact edges 129 and are guided to a position against respective interior edges 130 of notches 126.

Face portion 22 also includes a pair of spaced plates 132 located between apertures 40. Each plate 132 has a notch 134 that receives a portion of light pipe/actuator 143, as described in detail below with reference to FIG. 10. Light emitting diode 142 located on printed circuit board 109 is disposed in proximity to lens 141 of light pipe/actuator 143 so that light generated by light emitting diode 142 passes through the portion of lens 141 located in aperture 42 of housing 18. Battery status and diagnostic testing related to operational status of electronics carried by circuit board 109 may be conveniently performed with light from light emitting diode 142 being visible through aperture 42 to permit a rapid check of such testing, as described in more detail below.

Figure 5A:
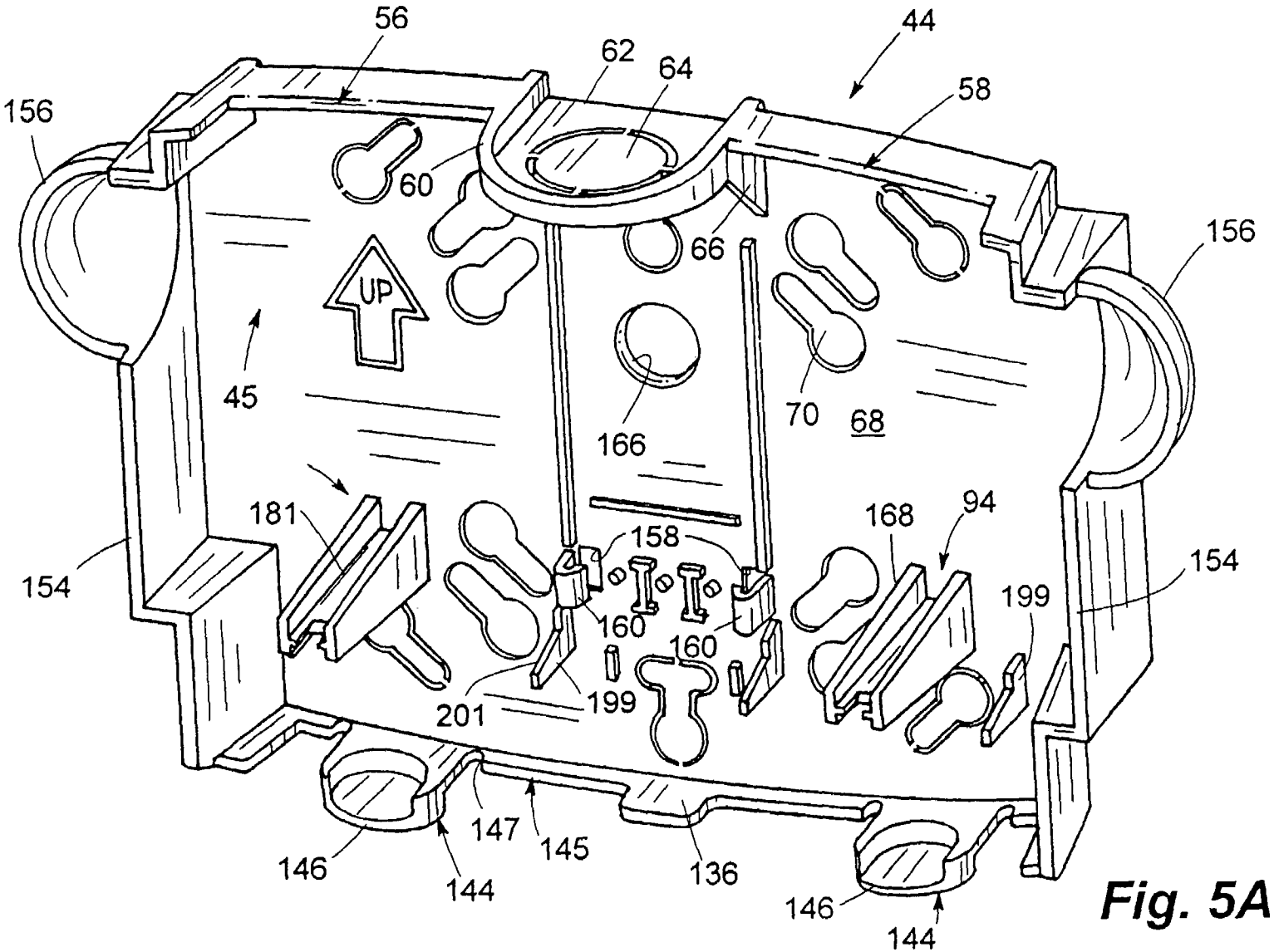
FIGS. 5A and 5B are perspective views of a back plate of the housing shown in FIGS. 1 and 2.
Figure 5B:
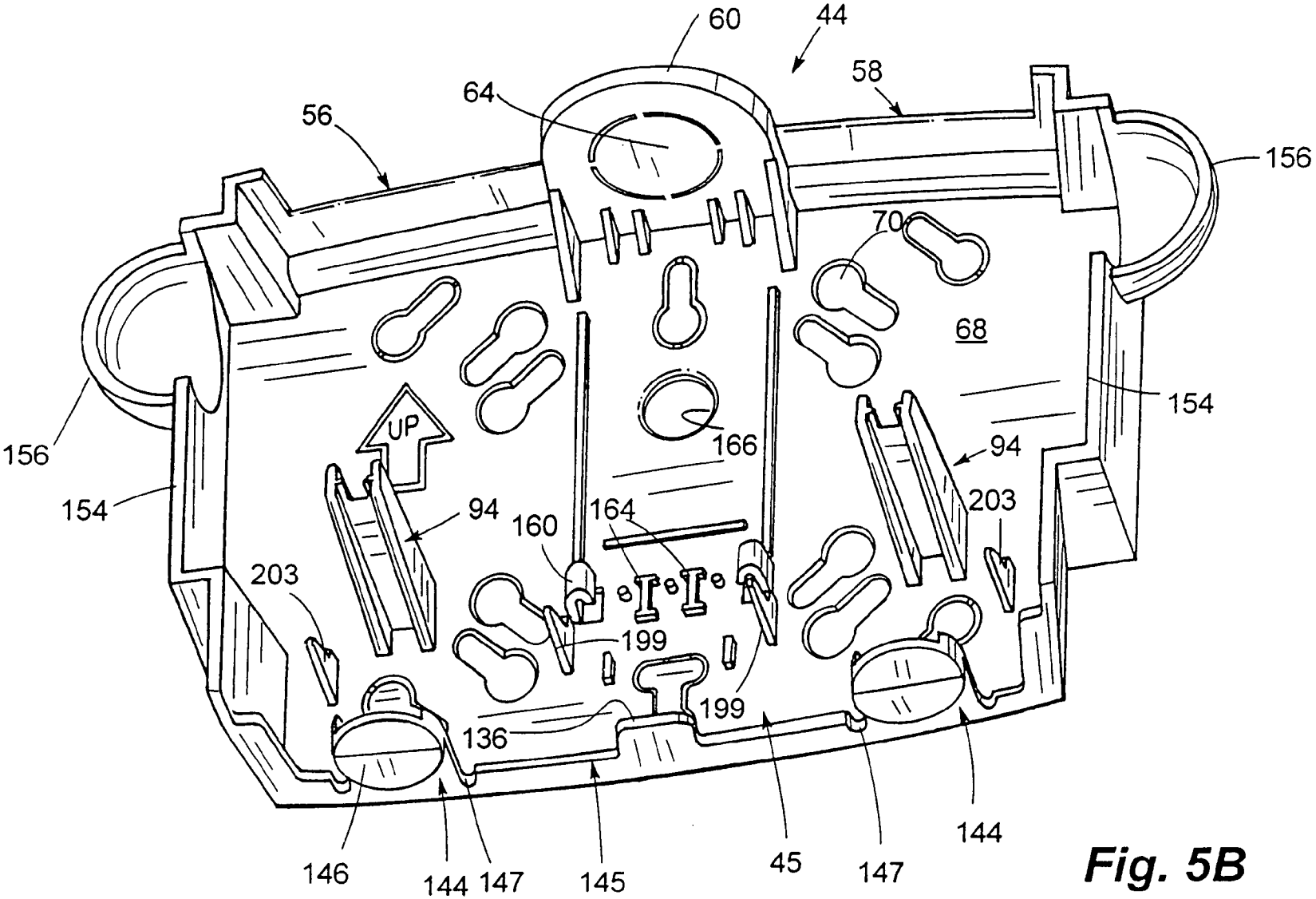

Referring to FIGS. 5A and 5B in particular and also to FIGS. 7A and 7B, back plate 44 includes snaps 144 formed along a lower peripheral edge 145 of back plate 44. Snaps 144 are spaced apart from a tab 136 located on edge 145. Each of snaps 144 has a generally circular snap plate 146 formed thereon. Distal portions of snap plates 146 are tapered to engage ramp portions 148 inset into the lower edge of apron 24 of face portion 22, as shown in FIGS. 4A and 4B. Ramp portions 148 may be depressions formed in apron 24 so that snap plates 146 can be guided into alignment with and snap fit into apertures 40 of face portion 22 to engage back plate 44 to face portion 22. Simultaneously, upper portions of edges 56 and 58 of back plate 44 snap fit beneath snap plates 54 of face portion 22, as described above, to positively engage back plate 44 to face portion 22 along the upper periphery of housing 18. Notches 147 are formed on each side of snaps 144 to permit desired flexing of snaps 144.

Upon engagement of back plate 44 to face portion 22, L-shaped walls 154 of back plate 44 fit against or near to edges of walls 102 of face portion 22 to define interior chamber 45 and substantially enclose components held within interior of housing 18. Semispherical walls 156 on opposite sides of back plate 44 shield, but do not generally engage or contact, openings 32 formed in face portion 22. Interior chamber 45 protects wiring, such as wiring 155 shown in FIG. 12 with fixed optical assembly 16, extending from the optical assembly of the luminaire for electrical connection with appropriate electronics (not shown) mounted by printed circuit board 109.

Generally rectangular openings 158 are included in back plate 44 as a manufacturing expedient. Hook-like tabs 160 extend from outermost vertical edges of openings 158. Tabs 160 hold a cover 162, as shown in FIG. 7B. Cover 162 includes side notches 163 that receive portions of tabs 160 to releasably mount cover 162 to back plate 44. Cover 162 also includes spaced slots 165 on its outer face that receive tongues 167 of printed circuit board 109. Tongues 167 of circuit board 109, shown in FIGS. 6, 8A, and 8B, include electrical contact pads 169 formed thereon, shown in FIG. 6, that engage electrical contacts 171 of wires 173, shown in FIG. 7A. Pads 169 electrically connect to circuitry (not shown) carried by circuit board 109, and wires 173 extend through an opening 166 in back plate 44 for connection to an external power source (not shown). Power is thereby provided to circuitry (not shown) housed within the luminaire during normal, non-emergency conditions.

Generally, tongues 167 of printed circuit board 109 act as an electrical "plug" that is plugged into a power source upon engaging face portion 22 and back plate 44. Face portion 22 and back plate 44 are aligned on assembly to permit entry of tongues 167 into spaced slots 165 and thus into engagement with electrical contacts 171. Angled guide elements 175 and 177 formed on either side of each slot 165 facilitate proper location of tongues 167 relative to slots 165. Cover 162 also has a series of notches 179 that receive ends of wires 173 and assist in holding wires 173 and electrical contacts 171 in place. Cover 162 is preferably formed as a separate component rather than being formed integrally with back plate 44 to allow placement of electrical contacts 171 between I-shaped ribs 164 formed on back plate 44, mounting cover 162 over electrical contacts 171.

As shown in FIGS. 5A, 5B, 7A, 7B, 9A and 9B, H-ribs 94 on back plate 44 each include a ramp edge 168 that acts to lift up T-ribs 86 of face portion 22 upon engagement of T-ribs 86 and H-ribs 94. Edges 92 of T-ribs 86 bias against bight portions 181 of H-ribs 94 to facilitate engagement between T-ribs 86 and H-ribs 94. Engagement between T-ribs 86 and H-ribs 94 transfers the weight of battery 78, as well as, at least partially, the weight of face portion 22 and other operational components of the luminaire, to back plate 44 and then to the structure to which the luminaire is mounted, such as wall 20. Thus, face portion 22 is not required to support the weight of battery 78, among other components. This minimizes sagging of housing 18 that results from "plastic creep" that often occurs in luminaires when heavy components contained within a plastic emergency unit luminaire must be supported by walls of the housing. The weight support structure described above permits the thickness of a plastic material used to form housing 18 to be reduced relative to the material thickness normally used for emergency luminaire housings. Additionally, reinforcement structure normally employed for providing support to such luminaire housings may be reduced when using the weight support structure described above.

Tab 136 of back plate 44, shown in FIG. 5A, is received along inner surfaces of apron 24 of face portion 22. Tab 136 provides support for central lower edge portions of back plate 44. Back plate 44 also includes guide plates 199 with lead-in ramps 201 that contact edges of an installed printed circuit board 109 to more positively locate printed circuit board 109 and provide at least some support for outer edges of printed circuit board 109. Two of guide plates 199 are located one each below hook-like tabs 160 and two other of guide plates 199 are located outside of H-ribs 94, as shown in FIGS. 5A and 5B.

FIG. 10 is a perspective view of a light pipe and test element actuator mountable to an embodiment of a face portion of a housing of this invention. Light pipe/actuator 143 includes lens 141. Lens 141 is elliptical in shape and sized to fit flush within aperture 42 formed in face portion 22. Lens 141 has a clear base 202 that functions as a "light pipe" and connects to a plate 204 having ears 206 and 208 at its opposing ends. An elongated cruciform element 210 extends upwardly from ear 208, as shown in FIG. 10. Plate 204 tapers to form an elongated body element 212 that curves at 214 to terminate in a generally rectangular plate 216. Plate 216 has spaced ribs 218 that extend from an upper face of plate 216, as shown in FIG. 10. Light pipe/actuator 143 is preferably formed as an integral piece of optically clear plastic material, although portions of light pipe/actuator 143 do not have to be so formed. When light pipe/actuator 143 is placed into face portion 22, aperture 42 receives lens 141 and plate 216 engages notches 134 formed in plates 132 on face portion 22 (see FIG. 4A). Ribs 218 are disposed in juxtaposition to inner wall surfaces of plates 132 to assist in properly positioning light pipe/actuator 143. Ears 206 and 208 bias against edges of plates 132 to prevent lens 141 from extending into aperture 42 to a greater degree than is desired.

The mounting of light pipe/actuator 143 described above permits flexing of light pipe/actuator 143 when lens 141 is depressed manually from housing 18 of a luminaire. Upon depression of lens 141, light pipe/actuator 143 flexes to depress a test switch 200 on printed circuit board 109 through contact of cruciform element 210 with test switch 200. The sequence of events beginning with depression of lens 141 and ending with depression of test switch 200 initiates a test sequence that includes disengagement of external power to the luminaire for simulation of mains power loss. Accordingly, battery 78, the circuitry (not shown) carried by printed circuit board 109, lamping, etc., may be tested and/or subjected to diagnostic procedures. Thus, light pipe/actuator 143 acts a push button, as well as a pathway for light from light emitting diode 142 such that the light is visible externally. As well understood by those skilled in the art, printed circuit board 109 includes discrete circuit elements (generally not shown except as noted herein) on its lower face and printed circuits (not shown) on its upper face, and contact pads 169 on tongues 167 connect to such circuits and circuit elements.

Figure 12:
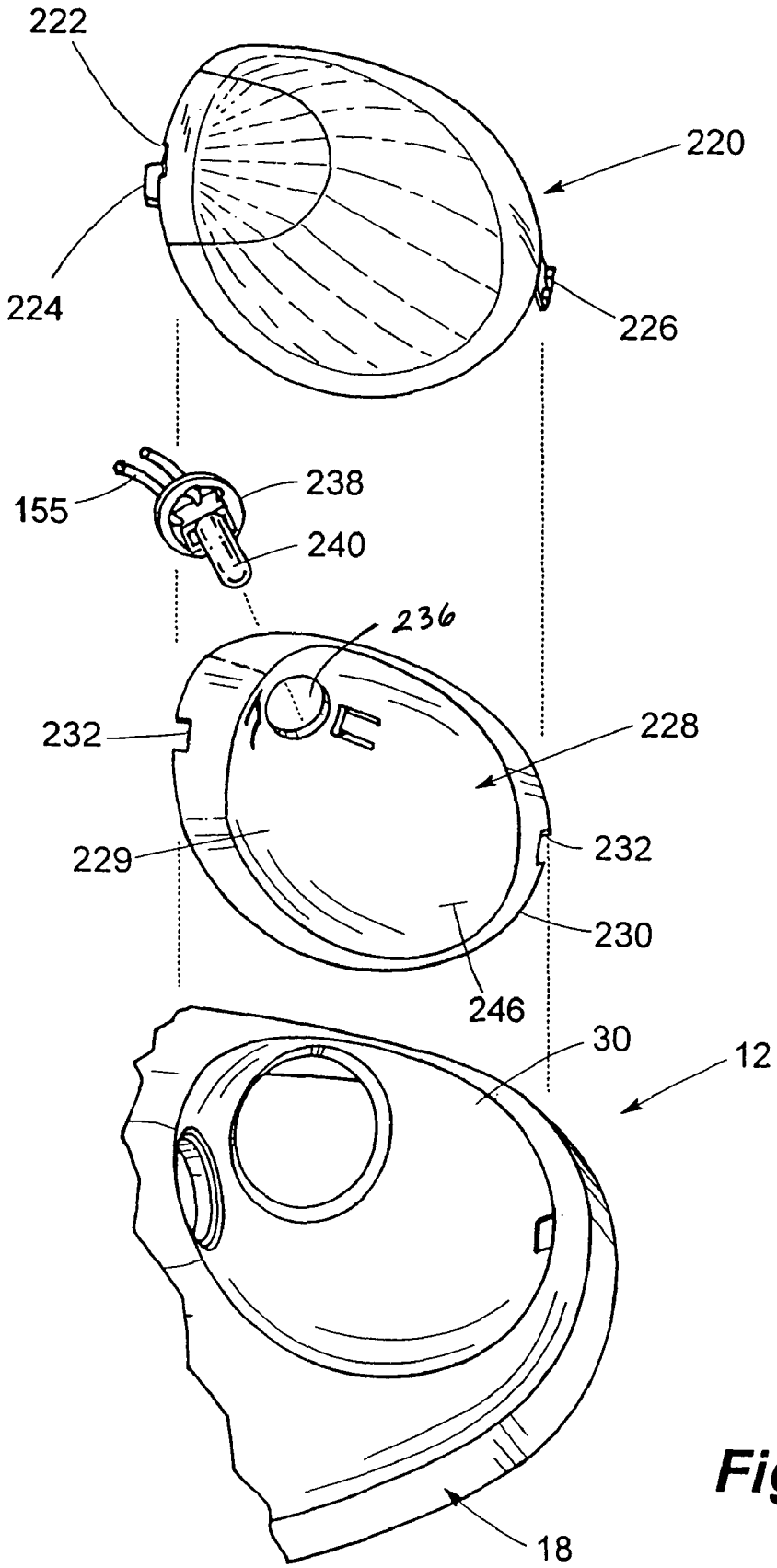
FIG. 12 is an exploded perspective view of a fixed optical assembly that may be used in an embodiment of a housing according to this invention and a portion of the housing.

FIG. 12 is an exploded perspective view of a fixed optical assembly that may be used in an embodiment of a housing of this invention. Fixed optical assembly 16 includes lens 220 shaped at its periphery to mate with the shape of concavity 30. Lens 220 has a notch 222 with a snap tab 224 disposed adjacently thereto. Snap tab 224 snap fits onto an edge of opening 34 in face portion 22 to facilitate mounting of lens 220 within concavity 30. It should be understood that opening 34 cannot have a movable optical assembly 14 mounted therein when a fixed optical assembly 16 is mounted within concavity 30. Lens 220 also includes a tab 226 that fits into rectangular opening 36 of face portion 22. Lens 220 is snap-fit to face portion 22 and removable by disengagement of lens 220 as permitted by the flexible nature of tabs 224 and 226.

A reflector 228 fits within concavity 30 and includes a peripheral flange 230 enlarged on opposite sides of the reflector. Flange 230 has notches 232 formed in the enlarged flanged portions, as shown in FIG. 12. Tabs 224 and 226 of lens 220 fit into notches 232 upon engagement of lens 220 and reflector 228. Reflector 228 also includes a body member 229 that is generally conical and extends inwardly to an opening 236 that receives an electrical socket 238 mounting a lamp 240. Electrical socket 238 is connected to printed circuit board 109 by wiring 155. Surfaces 246 of body member 229 may be coated with a reflective material in order to better direct light from lamp 240 outwardly.

Referring again to FIG. 6, battery 78 includes a wire 248 with an electrical connector 250 formed at its end. Electrical connector 250 connects to a connector 252 at an end of a wire 254 that is connected to printed circuit board 109. Wires 248 and 254 remain disconnected until the luminaire is installed so that battery 78 does not lose power before the luminaire is placed into service. Battery 78 is also connected to printed circuit board 109 through a wire 256 terminating in a connector 258, as shown in FIG. 6.

FIG. 13 is a rear perspective view of an embodiment of a housing according to this invention. Luminaire 12, also representative of luminaire 10, includes face portion 22 and back plate 44 snap fit together to form housing 18. Assembly of face portion 22 and back plate 44 as described above encloses battery 78, printed circuit board 109, and the associated electronics, wiring, and other operational components referred to herein.

Housing 18 can function as a housing for each of luminaires 10 and 12 without being modified and may take a variety of shapes and forms other than those shown in the exemplary embodiments described herein. Components contained within housing 18 that are necessary for operation of the luminaire, including battery 78, printed circuit board 109, and associated electronics, are conventional in nature and can take a variety of forms, as well understood by those skilled in the art. Housing 18 transfers at least some of the load associated with components, such as battery 78, and face portion 22 to the structure on which the luminaire is mounted. Face portion 22 and back plate 44 include cooperating structural elements acting to mount printed circuit board 109 as well as to enclose chamber 45 within which electrical and other operational components are contained.

Back plate 44 is mounted to wall 20 or a similar support with face portion 22 mounting electronic components and then being snapped to back plate 44 both quickly and readily without the need for tools. Upon snap fitting of face portion 22 to back plate 44, T-ribs 86 of face portion 22 engage H-ribs 94 of back plate 44 to transfer the weight of battery 78, among other components, to wall 20. Printed circuit board 109 also engages support elements on back plate 44 to facilitate an appropriate mounting of back plate 44 to face portion 22 with electrical connection to a power source being simultaneously accomplished. Face portion 22 may be readily disassembled from back plate 44 without the use of tools by manually pushing on both of snap plates 146 held within apertures 40 to displace snap plates 146 from apertures 40. Snap plates 54 can then be disengaged from edges 56 and 58 of back plate 44 to fully disengage face portion 22 from back plate 44. Accordingly, housing 18 can be rapidly assembled and disassembled as desired.

The foregoing description of the exemplary embodiments of the invention has been presented only for the purposes of illustration and description and is not intended to be exhaustive or to limit the invention to the precise forms disclosed. Many modifications and variations are possible in light of the above teaching. The embodiments were chosen and described in order to explain the principles of the invention and their practical application so as to enable others skilled in the art to utilize the invention and various embodiments and with various modifications, as are suited to the particular use contemplated. Alternative embodiments will become apparent to those skilled in the art to which the present invention pertains without departing from its spirit and scope.

What is claimed is:

1. A housing for an emergency unit luminaire, the housing comprising:

a concavity configured for interchangeable mounting of a movable optical assembly and a fixed optical assembly;

wherein the concavity comprises a larger central opening configured to receive a portion of a fixed optical assembly and a second, smaller opening spaced apart from the central opening, the second opening configured to receive a portion of a movable optical assembly.

2. The housing of claim 1, wherein the smaller opening is on a planar flat.

3. The housing of claim 2, wherein the concavity further comprises a third opening opposite the second opening, the second and third openings configured for snap fitting a lens of the fixed optical assembly into the concavity.

4. The housing of claim 1, further comprising:

a front portion of the housing including sloped projections extending from an interior surface of the front portion;

a back portion of the housing including receiving projections extending from an interior surface of the back portion; and surfaces of the sloped projections bias against surfaces of the receiving projections upon engagement of the front portion and the back portion to transfer weight associated with the front portion and the operational components to a structure of a building to which the back portion is mounted.

5. The housing of claim 1, further comprising:

a front portion of the housing that receives a printed circuit board, the printed circuit board including projections carrying electrical contact pads; and a back portion of the housing that mounts electrical contacts that are connected to a source of power external to the housing;

wherein, upon engagement of the front portion and the back portion, the back portion guides the projections of the printed circuit board into engagement with the electrical contacts to form at least a portion of an electrical circuit.

6. An apparatus comprising a housing for an emergency unit luminaire, the housing comprising (a) a concavity integrally formed in an outer surface of the housing, wherein the concavity is configured to interchangeably receive a movable optical assembly and a fixed optical assembly; and (b) first and second openings along an outer periphery of the concavity, wherein the first opening is positioned generally opposite the second opening and the first and second openings are configured for receiving at least a portion of a fixed optical assembly by snap fit.

7. The apparatus of claim 6, wherein the concavity includes a third opening configured to receive a portion of a movable optical assembly.

8. The apparatus of claim 6, wherein the concavity is angled downward.

9. The apparatus of claim 6, wherein the concavity is shaped such that a lens of a fixed optical assembly mates with the shape of the concavity when the fixed optical assembly is installed therein.

10. The apparatus of claim 6, wherein the concavity forms a generally semi-spherical surface that mates with a generally spherical movable optical assembly when mounted in the concavity and that mates with a fixed optical assembly when mounted in the concavity such that the fixed optical assembly does not protrude from the generally elliptical shape of a front portion of the housing.

11. The apparatus of claim 6, wherein the housing further comprises a test mechanism that tests the status of operational components of the luminaire, the test mechanism including:

a light-transmissive push button extending through an opening in the housing;

a light-transmissive base operable with the push button, wherein the base carries light from a light emitting diode on a printed circuit board inside the housing; and an element that engages a test switch on the printed circuit board upon depression of the push button to initiate a test sequence.

12. The apparatus of claim 11, wherein the push button, the base, and the element are integrally formed.

13. The apparatus of claim 6, wherein the housing further comprises a front portion and a back portion that are releasably coupled, wherein the front portion and back portion, when coupled, define a chamber that contains operational components of the luminaire.

14. The apparatus of claim 13, wherein:

the front portion receives a printed circuit board that includes projections carrying electrical contact pads; and the back portion mounts electrical contacts that are connected to a source of power external of the housing and, upon engagement of the front portion and the back portion, the back portion guides the projections of the printed circuit board into engagement with the electrical contacts to form at least a portion of an electrical circuit.

15. The apparatus of claim 13, wherein the front portion and the back portion are unitary structures formed of a plastic material.

16. The apparatus of claim 15, wherein the front portion and the back portion snap fit together.

17. An apparatus comprising a housing for an emergency unit luminaire, the housing comprising:

a concavity integrally formed in an outer surface of the housing, wherein the concavity is configured to interchangeably receive a movable optical assembly and a fixed optical assembly;

a front portion and a back portion that are releasably coupled, wherein the front portion and back portion, when coupled, define a chamber that contains operational components of the luminaire; and wherein the front portion and the back portion are unitary structures formed of a plastic material; the front portion includes sloped projections extending from an interior surface of the front portion; the back portion includes receiving projections extending from an interior surface of the back portion; and surfaces of the sloped projections bias against surfaces of the receiving projections upon engagement of the front portion and the back portion to transfer weight associated with the front portion and the operational components to a structure of a building to which the back portion is mounted.

* * * * *